US005280755A

United States Patent [19]

Batur

[11] Patent Number: 5,280,755

[45] Date of Patent: Jan. 25, 1994

[54] SECURITY CABINET

[76] Inventor: Dennis A. Batur, 411 Windtree Ave., Thousand Oaks, Calif. 91320

[21] Appl. No.: 941,301

[22] Filed: Sep. 4, 1992

[51] Int. Cl.[5] ..... E05G 1/024

[52] U.S. Cl. ..... 109/59 R; 292/DIG. 65; 292/DIG. 4; 292/36; 109/74; 109/50

[58] Field of Search ..... 109/50, 51, 59 R, 59 T, 109/73, 74; 292/DIG. 65, DIG. 4, 36; 312/242

[56] References Cited

U.S. PATENT DOCUMENTS

| | | | |
|---|---|---|---|
| 533,442 | 2/1895 | Deibert | 70/13 |
| 804,387 | 12/1905 | Davis | 70/57 |
| 1,509,285 | 9/1924 | Colbow, Jr. | 312/242 |
| 1,694,023 | 12/1928 | Suck | 292/DIG. 4 |
| 2,733,090 | 1/1956 | Coplen | 292/DIG. 65 |
| 3,064,851 | 11/1962 | Guigli | 292/DIG. 4 |
| 3,156,419 | 11/1964 | Wince | 292/DIG. 4 |
| 3,862,773 | 1/1975 | Bisbing | 292/DIG. 4 |
| 3,921,541 | 11/1975 | Chartrand et al. | 109/59 R |
| 4,370,935 | 2/1983 | Link | 109/74 |
| 4,647,091 | 3/1987 | Roubin | 292/DIG. 65 |
| 5,161,396 | 11/1992 | Loeff | 70/63 |

*Primary Examiner*—Peter M. Cuomo
*Assistant Examiner*—Darnell M. Boucher
*Attorney, Agent, or Firm*—Allan M. Shapiro

[57] ABSTRACT

A security cabinet for storing of articles of value which is designed to prevent unauthorized access into the security cabinet by individuals not possessing sufficient physical strength such as young children. The latching arrangement of the security cabinet can be located in a position requiring an inward force of a sufficient magnitude to be applied to the door in order to permit the door to be opened and thereby gain access into the cabinet.

12 Claims, 3 Drawing Sheets

SECURITY CABINET

BACKGROUND OF THE INVENTION

1) Field of the Invention

The field of this invention relates to safes, and more particularly to a security cabinet within which is to be stored articles of value where a certain amount of physical force is required to move the locking structure of the cabinet to an unlatching position where access into the enclosure of the security cabinet is permitted.

2) Description of the Prior Art

The use of safes to lock up articles of value has long been known. Every safe has a door. This door is to be moved from a closed position to an open position in order gain access into the safe. A locking device is associated with the door. Usually such a locking device is to be operated either through the use of a combination or by a key in order to move the locking device to an unlocked position which will then permit the movement of the door from a closed position to an open position.

It is common to place weapons such as pistols within such a security cabinet. The whole idea of the weapon generally is to provide protection to a homeowner or business owner within which the security cabinet is located. One of the primary reasons that the weapon is located in the security cabinet is to prevent unauthorized access to the weapon. Within a home where there are small children, and small children find a weapon such as a pistol, it is an attractive plaything that can cause injury and death.

To keep the weapon out of the hands of small children, it is common for individuals to locate the weapon within a security cabinet. However, if the situation occurs where immediate quick access to the weapon is required, such is not possible since the security cabinet is closed and locked and it will take some time to get the key and unlock the key lock of the cabinet or time to operate a combination of a combination lock to open the cabinet.

It would be desireable to construct a security cabinet where the locking device in conjunction with the cabinet can be positioned to permit immediate quick access by an adult but yet would prevent access by young children.

SUMMARY OF THE INVENTION

The structure of the present invention constitutes a cabinet which is totally closed with the exception of a door. The door can be locked by means of a latch which normally will be key-operated. In order to gain access into the cabinet, the lock can be moved to a position which permits opening of the door or can be moved to an intermediate position where access to the cabinet can only be obtained by applying of an inward physical force on the outside of the door with sufficient magnitude which causes the door to deflect inwardly which moves the latching device to a disengaged position and thereby permits the door to be opened. The door is mounted within a door frame with the door abutting against a border frame which is mounted against the inside surface of the door frame. A portion of this border frame is fixed, the portion which is directly adjacent to the hinge for the door. The portion of the border frame that is directly adjacent the latching device is capable of being deflected a limited amount relative to the door frame. The movement of the border frame is resisted by means of a spring arrangement which is predesigned to require a certain amount of force in order to affect this movement of the border frame. Increasing of the spring force will increase the force required to move the border frame.

The primary objective of the present invention is to construct a security cabinet which can be latched shut and is difficult if not impossible for a small child to affect opening but yet permits immediate quick opening for an adult.

DETAILED DESCRIPTION OF THE SHOWN EMBODIMENT

Figure 1:
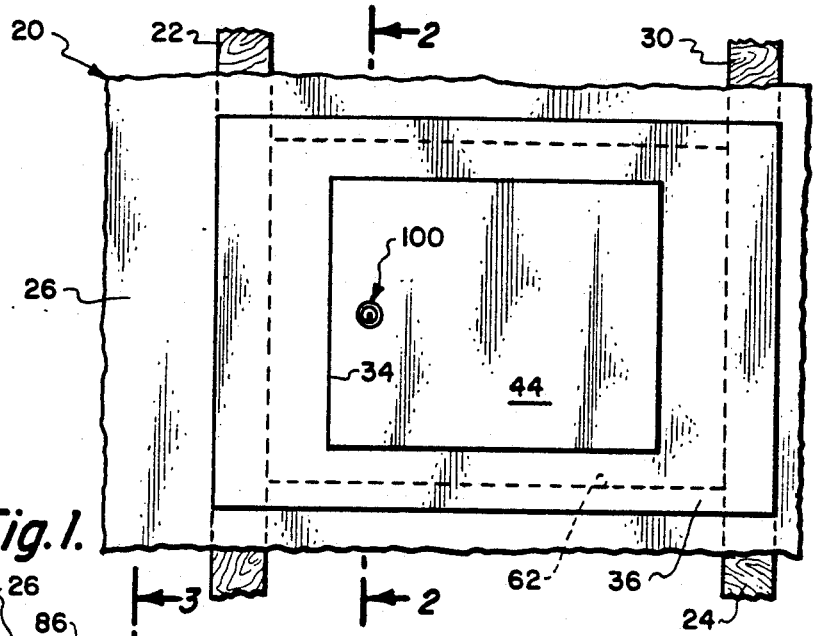
FIG. 1 is a front plan view of the security cabinet of the present invention showing such as it might be installed with a wall of a house or building.

Referring particularly to the drawings, there is depicted a vertical wall 20 which is constructed conventionally of a plurality of spaced apart vertically arranged studs 22 and 24 on which is nailed or otherwise secured plasterboard 26. Within the plasterboard 26 there is formed a cut-out opening 28. Within the cut-out opening 28 and located in the space 30 between the studs 22 and 24 is fixedly mounted the back wall section 32 of the enclosure cabinet. This back wall section 32 basically comprises a closed container with the exception of door opening 34 formed within door frame 36. Door frame 36 is welded or otherwise permanently affixed to the back wall section 32. The back wall section 32 is to be fixedly secured by means of screw fasteners 38 to the studs 22 and 24. The back wall section 32 will normally include at least a couple of the planar shelf members 40 and 42 on which articles of value (not shown) are to be stored. The use of such a box-like enclosure along the back wall section 32 and door frame 36 is deemed to be conventional and forms no specific part of this invention. Generally, the back wall section 32 is mounted some distance spaced from a floor (not shown) within a home or office which has been constructed using the studs 22 and 24 and the plasterboard 26.

Door opening 34 is normally closed by means of a door 44. Normally, door 44 as well as the back wall section 32 and the door frame 36 will be constructed of sheet metal such as steel. However, it is considered to be within the scope of this invention that other materials could be utilized such as a plastic. The door 44 fits closely within the size of the door opening 34. Fixedly secured to the inside surface directly adjacent the inner edge of the door 44 is a U-shaped hinge cover plate 46. Fixedly secured to the U-shaped hinge cover plate 46 is a door leaf 48 of a hinge. This door leaf 48 is pivotally connected by a pin 50 to a frame leaf 52. Both the frame leaf 52 and the door leaf 48 include an aligned set of knuckles through which the pin 50 passes. The door leaf 48, the pin 50 and the frame leaf 52 form the hinge. The frame leaf 52 may be secured by welding or by a screw fastener 54 to the inside surface of the door frame 36. It is to be noted that the door frame 36 extends laterally outward past the back wall section 32 with this portion of the door frame 36 resting against the outside surface of the plasterboard 26 surrounding the opening 28.

Figure 9:
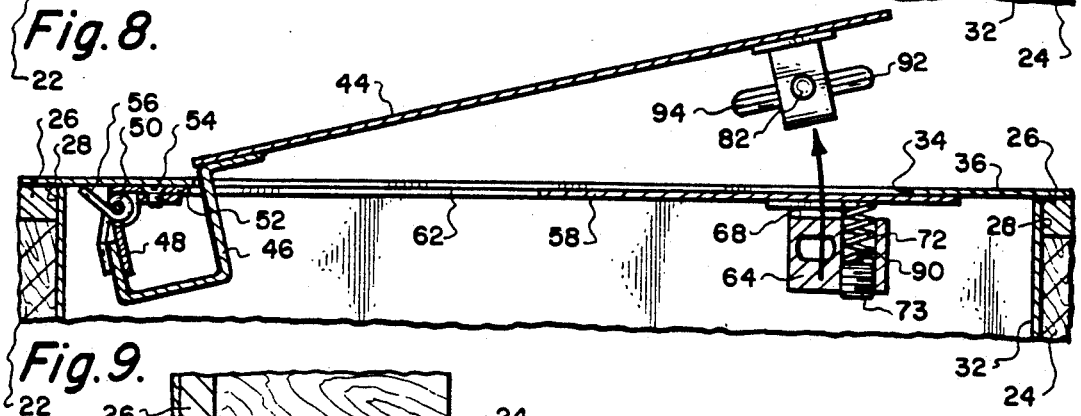
FIG. 9 is a view similar to FIG. 7 but showing the door in an open position permitting access to the interior of the security cabinet.
Figure 10:
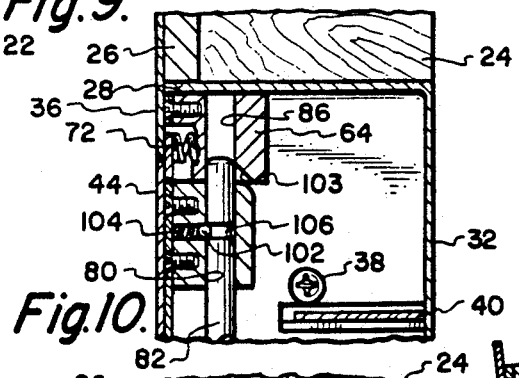
FIG. 10 is a cross-sectional view through the locking device included within the security cabinet of the present invention taken along line 10—10 of FIG. 5 showing a latching pin of the locking device in the position of the intermediate locking position of FIG. 5.
Figure 11:
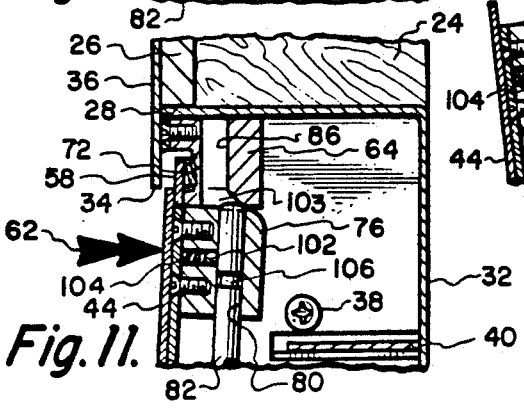
FIG. 11 is a view similar to FIG. 10 but showing the position of the latching pin when the door is in the position of FIG. 8.
Figure 12:
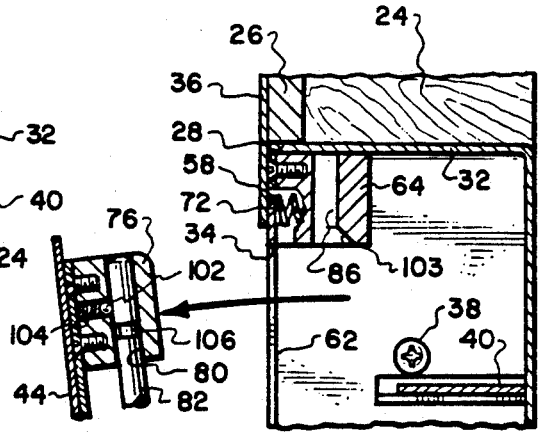
FIG. 12 is a view similar to that of FIG. 10 but showing the latching pin in the position when the door is open as in FIG. 9.

It is desireable to have the door 44 be biased continuously to the open position which is shown in FIGS. 9 and 12 of the drawings. In order to achieve this, there is incorporated a spring 56 mounted in conjunction with the knuckles of the hinge which is produced by the frame leaf 52 and the door leaf 48. A spring 56 is mounted about pin 50. This spring 56 exerts a continuous spring bias on the door 44 tending to locate the door 44 in the open position. However, the door 44 when mounted within the opening 34 is capable of being latched when lockingly held in that position by means of a latching device which is capable of being locked in position. The description of this latching device is as follows:

Mounted on the inside surface of the door frame 36, about the door opening 34, is a border frame 58. This border frame 58 is basically bifurcated forming a pair of leg members at its inner end which are fixedly secured as by welding to the inner inside wall surface of the door frame 36. Between these leg members of the border frame 58 there is located a gap 60. It is within the gap 60 that the hinge, previously described, is mounted.

Figure 8:
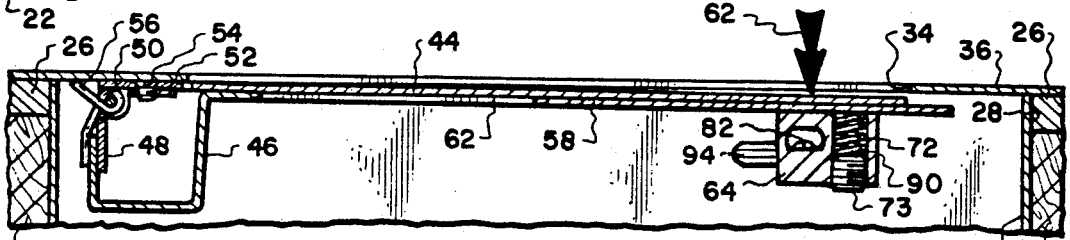
FIG. 8 is a view similar to FIG. 7 but showing inward pressure being applied to the outside of the door deflecting the door which would be the position which the door would occupy to affect opening of the door when the locking device is in the intermediate position shown in FIG. 5.

The outer section of the border frame 58 is not attached to the inside wall surface of the door frame 36. This border frame 58 defines a border frame opening 62. This border frame opening 62 is of the same configuration, that is rectangular, as opening 34. Border frame opening 62 is also just slightly smaller in size than opening 34 and is centered relative to opening 34. As a result, the door 44 when closed rests against a portion of the outer wall surface of the border frame 58. If a force is applied in the direction of arrow 62 against the door 44 pushing it inwardly, the door 44 and the outer section of the border frame 58 will deflect inwardly as is shown in FIG. 8 of the drawings. However, the amount of this deflection is limited with generally no more than a quarter to three eighth of an inch being permitted. What limits this bending movement of the outer portion of the border frame 58 are blocks 64 and 66.

Block 64 is fixedly mounted on the inside wall surface of the door frame 36 along the upper edge of the border frame 58 while the block 66 is similarly mounted on the inside wall surface of the door frame 36 along the bottom of the border frame 58. Block 64 is also fixedly secured to back wall section 32. Both blocks 64 and 66 include a cut-out area 68 and 70, respectively, which limits the amount of inward movement of the outer portion of the border frame 58. Within the cut-out area 68 is located a coil spring 72. A similar coil spring 74 is located within cut-out area 70. The function of the springs 72 and 74 is to exert a bias against the outer portion of the border frame 58 tending to position this outer section of the border frame 58 against the inside wall surface of the door frame 36. In other words, the inward force supplied in the direction of arrow 62 must overcome the force of the springs 72 and 74 and compress such. The force of springs 72 and 74 can be varied by removing set screw 73 for spring 72 and set screw 75 for spring 74 and substituting a spring with a different compressing force.

Fixedly mounted on the inside surface of the door 44 are blocks 76 and 78. Block 76 includes a through hole 80 within which is slidingly mounted a pin 82. In a similar manner within the block 78 there is located a through hole 84 with a pin 85 being slidingly mounted therein. Pin 82 is capable of sliding within hole 86 formed within block 64 with such occurring when the door 44 is in the closed position and aligned with the door frame 36. In a similar manner the pin 85 is capable of entering hole 88 formed within the block 66. Holes 86 and 88 are longitudinally oversized to provide side clearance for pins 82 and 85.

Figure 3:
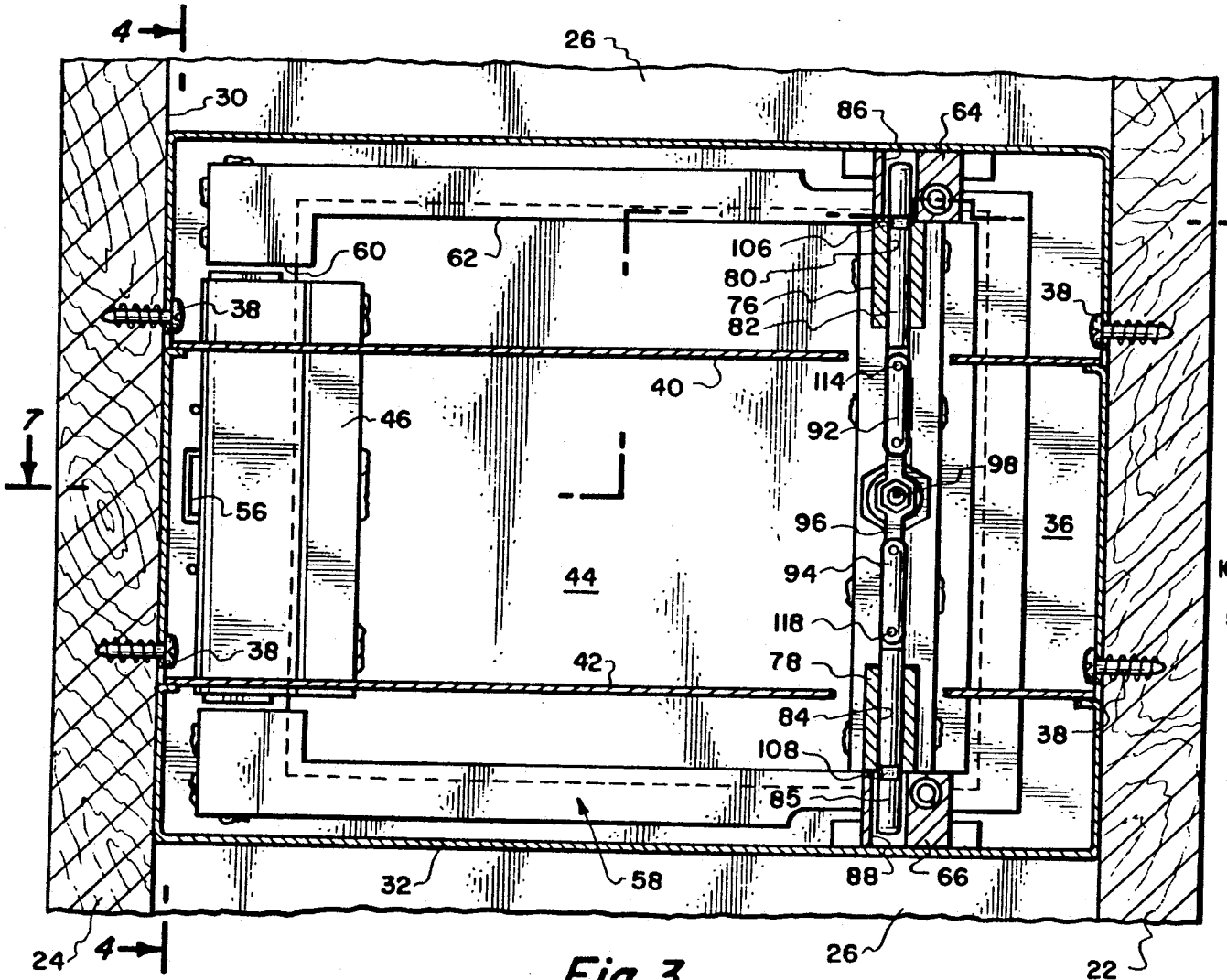
FIG. 3 is a back view of the door frame of the security cabinet of the present invention taken along line 3—3 of FIG. 2.
Figure 7:
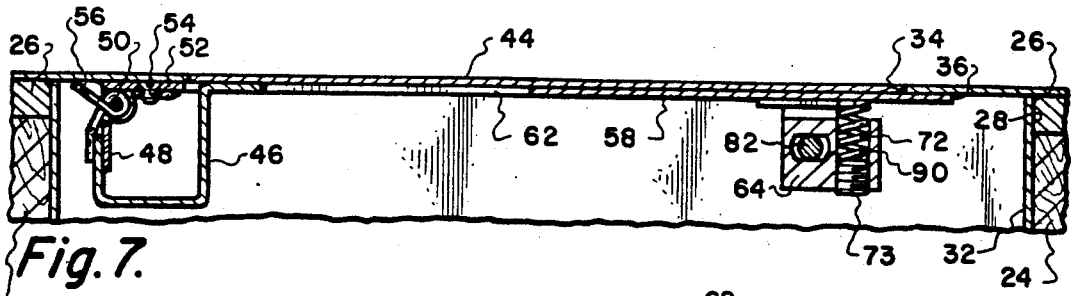
FIG. 7 is a cross-sectional view through the security cabinet of the present invention taken along line 7—7 of FIG. 3 showing the door in the closed position.

Each of the springs 72 and 74 are mounted within a recess within its respective block 64 and 66 with only recess 90 being shown for block 64. The inner end of the pin 82 is pivotally connected to a link 92. A similar link 94 is pivotally connected to the inner end of the pin 85. Links 92 and 94 are pivotally connected to an arm 96. This arm 96 is pivotally mounted on a shaft 98. Shaft 98 is part of a key operated locking mechanism 100. Key operated locking mechanism 100 is mounted within the door 44. When the correct key is inserted within the locking mechanism 100, shaft 98 is capable of being pivoted from the locked position shown in FIG. 3 to a totally unlocked position shown in phantom in FIG. 5. With the locking mechanism 100 in the locked position as shown in FIG. 3, the pin 82 connects with hole 86 and pin 85 is located within opening 88 and opening of the door 44 is prevented. However, when the proper key is inserted into the locking mechanism 100, the arm 96 is pivoted approximately one hundred and five degrees to its fullest extent shown in phantom in FIG. 5, pin 82 is removed from hole 86 and pin 85 is removed from hole 88 permitting movement of the door 44 to the open position.

Link 92 pivotally connects through pin 114 with elongated slot 116 formed in pin 82. Link 94 pivotally connects through pin 118 with elongated slot 120 formed in pin 85. Pins 114 and 118 are located at the inner end of their respective slots 116 and 120 when the locking mechanism 100 is located in the locked position and in the intermediate position. When the locking mechanism 100 is in the open position, shown in FIG. 6 created by applying force indicated by arrow 62, the pins 114 and 118 are located at the outer end of their respective slots 116 and 120. When the locking mechanism is in the open position shown in phantom, numeral 97, in FIG. 5, the pins 114 and 116 are located at the inner end of their respective slots 116 and 120 with this position being obtained by moving the key generated lock 100 to this position.

Figure 5:
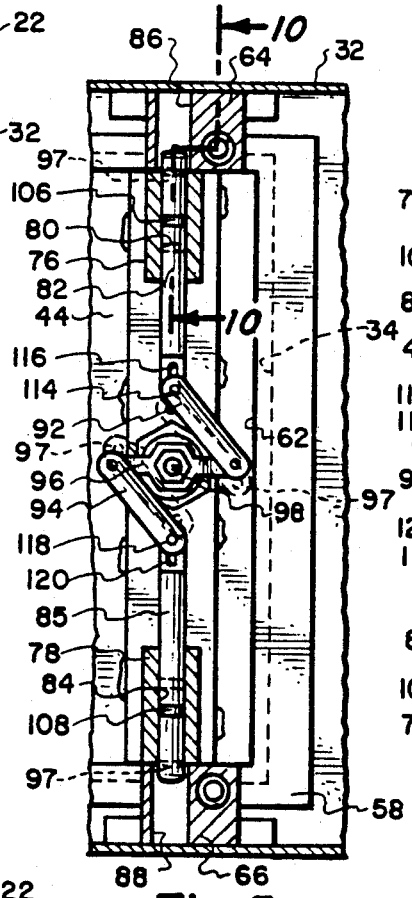
FIG. 5 is a view of the locking device utilized in conjunction with the security cabinet of the present invention showing the locking device in an intermediate latching position as opposed within FIG. 3 where it is in the totally locked position.
Figure 6:
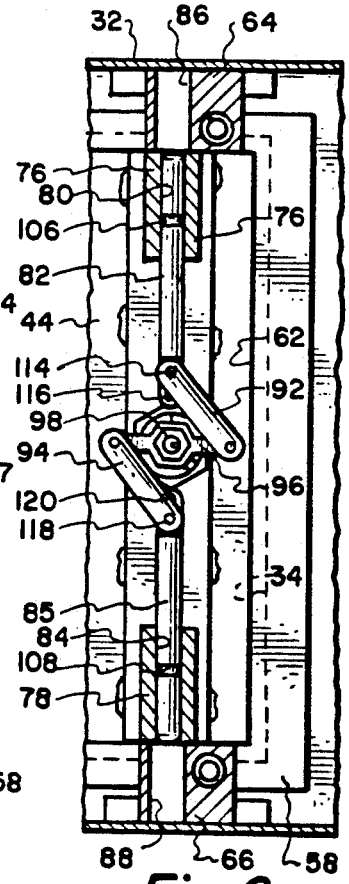
FIG. 6 is a view similar to FIG. 5 but showing the locking device in a totally unlocked position which has been unlocked by the application of force.
Figure 4:
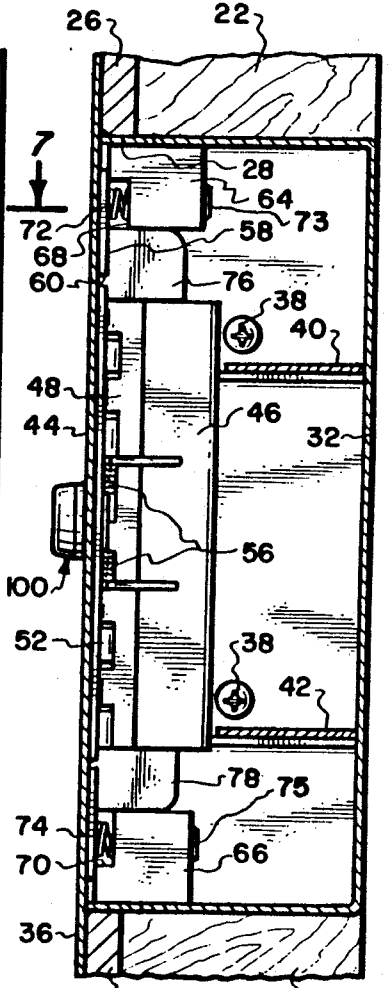
FIG. 4 is a end view, partly-in-cross-section, of the security cabinet of the present invention taken along line 4—4 of FIG. 3.

However, locking mechanism 100 can be moved to an intermediate position which is where arm 96 is pivoted about ninety degrees and this position is clearly shown in solid lines in FIG. 5 of the drawings. In this position, the pin 82 is still slightly engaged with the hole 86 and pin 85 is similarly slightly engaged with the hole 88. However, associated with the hole 86 is a cam surface 103. A similar such cam surface is formed within the block 66 and pin 85 is located directly against that cam surface. The door 44 is still located in the closed position. Movement of the door 44 to the open position is prevented by the fact that the pins 82 and 85 are still positioned within a portion of their respective holes 86 and 88.

It is desirable to incorporate a detent mechanism in conjunction with the pins 82 and 85 that applies a slight force tending to maintain the locking pins 82 and 85 in their intermediate position. Block 76 has a small metallic ball 102 mounted therein. Also mounted in block 76 is a coil spring 104 which exerts a slight outward force against ball 102. Ball 102 physically contacts pin 82 and slightly enters annular groove 106 formed on pin 82. This produces the detent mechanism. For pin 85, there is a groove 108 which connects with ball 110 which is biased by coil spring 112 which is mounted in block 78. Balls 102 and 110 simultaneously connect with their respective grooves 106 and 108.

Upon an inward manual force being applied to the door 44, as represented by arrow 62, pin 82 slides along cam surface 103 with a similar such sliding movement occurring between pin 85 and its respective cam surface (not shown). This causes pins 82 and 85 to be moved toward each other. When the force represented by arrow 62 is released, the spring 50 automatically moves the door to the open position as the pins 82 and 85 are no longer located within any portion of their respective holes 86 and 88. In actual practice, the amount of force 62 that would be required to do this would be normally within the range of fifty to four hundred pounds which would be the amount of force capable of being generated by an adult but would be difficult or impossible to be generated by a child.

Figure 2:
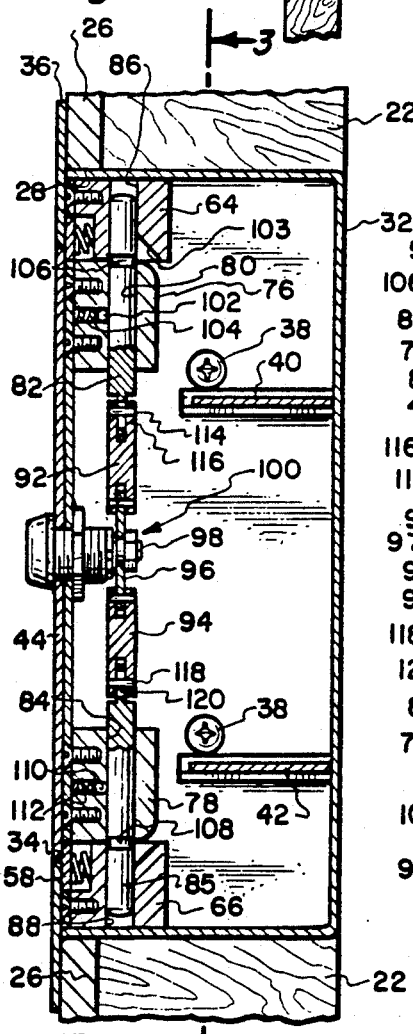
FIG. 2 is a vertical cross-sectional view through the security cabinet of the present invention taken along line 2—2 of FIG. 1.

Once the door 44 is in the open position, access within the enclosure formed by back wall section 32 is permitted to the articles of values that may be stored therewithin. When it is desired to reclose the enclosure, the user is required to move the door 44 to the closed position and then operate the locking mechanism 100 by means of a key to cause the pins 82 and 85 to respectively connect with holes 86 and 88. This is a position that is shown in FIGS. 2 and 3 of the drawings.

The locking position 97 shown in phantom in FIG. 5 can be omitted with unlocking of the cabinet only being permitted by the application of force.

What is claimed is:

1. A security cabinet comprising:

an enclosure, said enclosure being adapted to receive articles of value, said enclosure having an access opening providing access into said enclosure;

a rigid door frame mounted about said access opening, said door frame being fixedly secured to said enclosure, said door frame having an exterior surface exposed to the ambient and an interior surface connected with said enclosure, said door frame defining said access opening;

a rigid border frame mounted within said enclosure and lying against said interior surface of said door frame and lying substantially therearound, said border frame having a second opening, said border frame being mounted at said access opening with said second opening being smaller than said access opening, said border frame having an inner portion and an outer portion, said inner portion being fixed to said door frame, said outer portion being moveable relative to said door frame;

a door pivotally mounted on and lying within said door frame, said door lying against said border frame, said door being pivotally mounted on a hinge and movable between a closed position and an open position, said door having a continuous solid face to close said access opening when said door is in its closed position, said open position permitting access into said enclosure, said door in said closed position lying against said border frame preventing access into said enclosure; and a latching means connected between said door and said door frame, said latching means comprising a lock, said lock having locked, intermediate and open positions, said lock controlling a pin and said pin having locked, intermediate and open positions, said lock and said pin being mounted on said door, a block within said enclosure, said lock pin being engaged in said block in its locked and in its intermediate position to prevent said door from swinging outward from said access opening of said enclosure to inhibit access to the interior of said enclosure, said pin in its open position being withdrawn out of engagement with said block to permit opening of said door, a ramp in said block adjacent said pin, said ramp being positioned so that when said pin is in its intermediate position and said door is pressed against said border frame and said border frame is deflected, said ramp moves said pin from its intermediate position to its unlocked position so that upon a physical force of sufficient magnitude being applied against said door, causing said outer portion of said border frame to deflect so that said pin is moved from its intermediate to its open position, movement of said door to said open position is permitted.

2. The security cabinet as defined in claim 1 wherein:

a spring means connecting with said outer portion of said door frame, said spring means exerting a continuous spring bias against said outer portion of said border frame biasing said outer portion into connection with said door frame.

3. A security cabinet comprising:

an enclosure, said enclosure being adapted to receive articles of value, said enclosure having an access opening providing access into said enclosure;

a rigid door frame mounted about said access opening, said door frame being fixedly secured to said enclosure, said door frame having an exterior surface exposed to the ambient and an interior surface connected with said enclosure, said door frame defining said access opening;

a rigid border frame mounted within said enclosure and lying against said interior surface of said door frame and lying substantially therearound, said border frame having a second opening, said border frame being mounted at said access opening with said second opening being smaller than said access opening;

said second opening being essentially of the same configuration as said access opening, the wall surface of said second opening being evenly spaced from the wall surface of said access opening, said border frame having an inner portion and an outer portion, said inner portion being fixed to said door frame, said outer portion being moveable relative to said door frame;

a door pivotally mounted on and lying within said door frame, said door lying against said border frame, said door being pivotable by a hinge between a closed position and an open position, said door having a continuous solid face to close said access opening when said door is in its closed position, said open position permitting access into said enclosure, said door in said closed position lying against said border frame preventing access into said enclosure; and a lock extending through said continuous door face so that said lock is accessible from the front of said enclosure, said lock having locked, intermediate and open positions, said lock controlling a pin and said pin having locked, intermediate and open positions, said lock and said pin being mounted on said door, a block within said enclosure, said lock pin being engaged in said block in its locked and in its intermediate position to prevent said door from swinging outward from said access opening of said enclosure to inhibit access to the interior of said enclosure, said pin in its open position being withdrawn out of engagement with said block to permit opening of said door, a ramp in said block adjacent said pin, said ramp being positioned so that when said pin is in its intermediate position and said door is pressed against said border frame and said border frame is deflected, said ramp moves said pin from its intermediate position to its unlocked position so that upon a physical force of sufficient magnitude being applied against said door, causing said outer portion of said border frame to deflect said door so that said pin is moved from its intermediate to its open position, movement of said door to said open position is permitted.

4. The security cabinet as defined in claim 1 wherein:

said hinge being mounted at said inner portion of said border frame.

5. The security cabinet as defined in claim 1 wherein:

second spring means being associated with said hinge, said spring means exerting a continuous bias on said door tending to locate said door in said open position.

6. The security cabinet as defined in claim 1 wherein:

said door being smaller than said first enlarged opening but larger than said second enlarged opening.

7. The security cabinet as defined in claim 6 wherein:

said second enlarged opening being essentially of the same configuration as said first enlarged opening, the wall surface of said second enlarged opening being evenly spaced from the wall surface of said first enlarged opening.

8. The security cabinet as defined in claim 7 wherein:

said hinge being mounted at said inner portion of said border frame.

9. The security cabinet as defined in claim 8 wherein:

second spring means being associated with said hinge, said spring means exerting a continuous bias on said door tending to locate said door in said open position.

10. The security cabinet as defined in claim 9 wherein:

said latching means being positionable in a totally latched position, with said latching means in said totally latched position movement of said door and said outer portion of said border frame relative to said door frame is prevented.

11. The security cabinet as defined in claim 10 wherein:

a spring means connecting with said outer portion of said door frame, said spring means exerting a continuous spring bias against said outer portion of said border frame biasing said outer portion into connection with said door frame.

12. A security cabinet comprising:

an enclosure, said enclosure adapted to receive articles of value, said enclosure having an access opening providing access into said enclosure;

a rigid door frame mounted about said access opening, said door frame being fixedly secured to said enclosure, said door frame having an exterior surface exposed to the ambient and an interior surface connected with said enclosure, said door frame defining said access opening;

a door pivotally mounted on and lying within said door frame, said door being pivotable by a hinge between a closed position and an open position, said door lying substantially flush with said door frame when in the closed position, a resilient stop on said enclosure, said stop having an undeflected position and a resiliently deflected position, said door lying against said stop in its undeflected position when said door is in its substantially flush closed position, said door having a face to close said access opening when said door is in its closed position, said open position permitting access into said enclosure; and a lock on said enclosure so that said lock is accessible from the front of said enclosure, said lock having locked, intermediate and open positions, said lock controlling a pin and said pin having locked, intermediate and open positions, said pin being mounted on said door, means accessible from the front of said enclosure to turn said lock so that said pin moves between its locked, intermediate and open positions, a block within said enclosure, said lock pin being engaged in said block in its locked and in its intermediate positions to prevent said door from swinging outward from said access opening of said enclosure to inhibit access to the interior of said enclosure, said pin in its open position being withdrawn out of engagement with said block to permit opening of said door, a ramp adjacent said pin, said ramp being positioned so that, when said door is pressed against said resilient stop to its resiliently deflected position, said ramp moves said pin from its intermediate position to its unlocked position so that upon a physical force of sufficient magnitude being applied against said door, causing said resilient stop to deflect so that said pin is moved from its intermediate to its open position, movement of said door to said open position is permitted.

* * * * *